United States Patent [19]

Bauer

[11] Patent Number: 4,932,300

[45] Date of Patent: Jun. 12, 1990

[54] CONTROL MECHANISM FOR ADJUSTING THE PUNCH TOOL CARRIAGE STROKE OF A PUNCH PRESS

[75] Inventor: Karl-Heinz Bauer, Ennepetal, Fed. Rep. of Germany

[73] Assignee: Carl Ullrich Peddinghaus, Wuppertal-Barmen, Fed. Rep. of Germany

[21] Appl. No.: 316,757

[22] Filed: Feb. 28, 1989

[30] Foreign Application Priority Data

Mar. 4, 1988 [DE] Fed. Rep. of Germany ..... 3807076

[51] Int. Cl.[5] ..... B26F 1/14

[52] U.S. Cl. ..... 83/530; 83/684; 83/145

[58] Field of Search ..... 83/527, 530, 529, 684, 83/145, 146, 522, 522.15

[56] References Cited

U.S. PATENT DOCUMENTS 4,378,717 4/1983 Schneider et al. ..... 83/530

FOREIGN PATENT DOCUMENTS 72282258 3/1973 Fed. Rep. of Germany .

7425321 7/1974 Fed. Rep. of Germany .

*Primary Examiner*—Douglas D. Watts

*Assistant Examiner*—Kenneth E. Peterson

*Attorney, Agent, or Firm*—Herbert Dubno; Ronald Lianides

[57] ABSTRACT

The punch press with a control mechanism for the displacement of a punch tool carriage and a punch tool mounted therein comprises a machine frame, a punch tool carriage movable up and down in the machine frame, a die-bearing member having a workpiece receiving portion mounted on the machine frame positioned opposite the punch tool carriage, a stripper on the machine frame adjustable in height for different workpiece thicknesses and a control mechanism having a plurality of controlling element pairs including a plurality of control cams and associated control switches. An additional control switch connected with a controlling element support extending vertically upward from the stripper is provided and one of the control cams associated with the additional control switch is slidably mounted on twin guide rods on the punch tool carriage and positioned on the punch tool carriage according to the different lengths in the punch travel direction of different punch tools and/or according to the height of the stripper.

7 Claims, 1 Drawing Sheet

CONTROL MECHANISM FOR ADJUSTING THE PUNCH TOOL CARRIAGE STROKE OF A PUNCH PRESS

FIELD OF THE INVENTION

My present invention relates to a punch or punch press and, more particularly, to a punch with a control mechanism for adjusting the punch tool carriage stroke.

BACKGROUND OF THE INVENTION

The punch of German Utility Model DE-GM 7228225 has a control mechanism for the displacement of a punch tool carriage.

The punch comprises a machine frame, a punch tool carriage which is movable up and down in the machine frame, a die-bearing or anvil member having a workpiece receiving portion fixed in position relative to the machine frame positioned opposite the punch tool carriage and a stripper mounted on the machine frame and adjustable in height for different workpiece thicknesses.

The control mechanism has a plurality of controlling element pairs including a plurality of control cams and associated control switches. One controlling element of the controlling element pairs is mounted on the punch tool carriage while the associated controlling element is mounted on a portion of the machine frame.

The height adjustability of the stripper can be provided in different ways (see, for example, German Utility Models, 72 28 225, 74 25 321).

In the known punch machine described above on which the invention is based, i.e. on German Utility Patent 72 28 225, the controlling mechanism acts so that the downward directed working stroke of the punch carriage is limited and the motion of the punch tool carriage reverses at a lower dead point for the return stroke.

A control cam is mounted on the punch tool carriage and a control switch is mounted on a holder which is attached to the machine frame. Generally a suitable design limits the uppermost position for the punch tool carriage.

The described arrangement for the control of the lower turning point of the working displacement is such that the stripper is adjustable independently of it, so that its height adjustment has no influence on control of the punch tool carriage stroke.

Punch machines of the above-described structure are designed to receive punch tools with different lengths in the punch direction. The uppermost position for the carriage is suitably adjusted and this adjustment does not take into consideration the height of the stripper which is different according to different workpiece thicknesses. As a result the displacement, i.e. the distance between the lower turning point and the upper turning point, is not optimized and not easily adjustable to the described different working parameters, namely the workpiece thickness and the displacement of the punch tool.

By "displacement" or "stroke" of the punch tool or its carriage I mean the distance traveled in one direction by the punch tool or its carriage during a single punch stroke.

OBJECT OF THE INVENTION

It is an object of my present invention to provide a punch machine of the above-described kind in which variations in workpiece thickness and also different lengths of the punch tools may be easily taken into account during control or adjustment of the displacement of the punch tool carriage and/or punch tool.

SUMMARY OF THE INVENTION

According to my invention, in the punch or stamping machine an additional displacement-controlling element connected with the stripper is provided and a controlling element associated with this additional displacement-controlling element is positioned on the punch tool carriage according to the different lengths of the punch tools used in the displacement direction of the tools.

If a punch tool is replaced with one of a different length in the punch and if the workpiece thickness and thus the height adjustment of the stripper remains unchanged, according to my invention the controlling element on the punch tool carriage must be correspondingly changed so that the upper position of the punch tool carriage is kept constant.

This can be done without difficulty because of the displacement-controlling element connected to the stripper.

If the height adjustment of the stripper is changed because of the workpiece thickness change, the movable controlling element on the punch tool carriage associated with the displacement-controlling element is easily repositioned for adjustment of the uppermost position or turning point of the punch tool carriage.

When both variables, i.e. the height adjustment of the stripper and the size of the punch tool change, I can effect adjustment similarly.

As in the known punch machines on which my invention is based, the controlling elements for the lower turning or dead point of the punch tool carriage can be adjusted. However, additional controlling elements for additional positions of the punch tool carriage, e.g. its uppermost turning point, can be provided, if the punch tool is to be replaced.

Advantageously, the displacement-controlling element connected with the stripper comprises a control switch and the associated controlling element on the punch tool carriage comprises a control cam.

To mount the displacement-controlling element in an easy way, the stripper is provided with a controlling element support for the displacement-controlling element, which is guided vertically upward in the vicinity of the punch tool carriage.

The adjustment may be particularly simple and precise when the controlling element associated with the displacement-controlling element on the punch tool carriage is guided on two vertical guide rods. It can be fixed in position by clamping screws, for example. A measuring scale can be mounted in the vicinity of the adjustable controlling element on the punch tool carriage which allows its set position to be read. The control switch can be either a contact switch or a proximity detector.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 2:
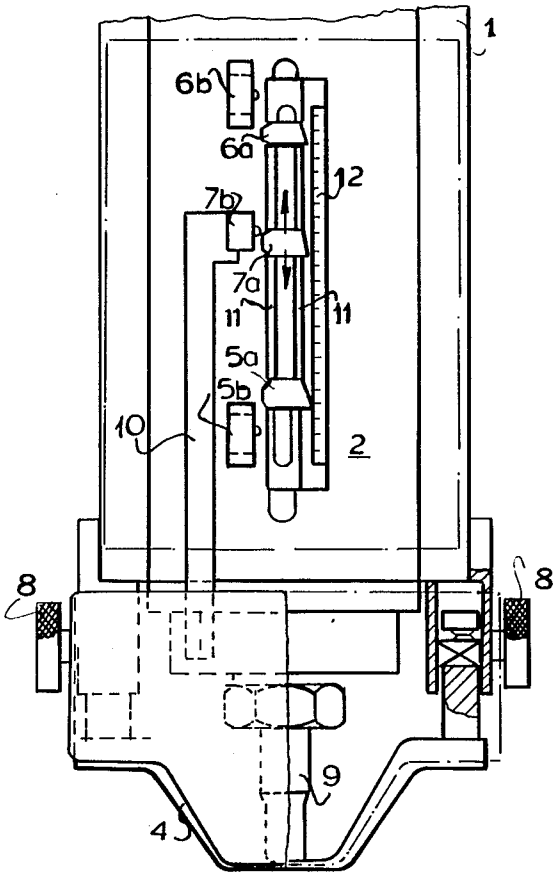
FIG. 2 is a front elevational view of the apparatus of FIG. 1.
Figure 1:
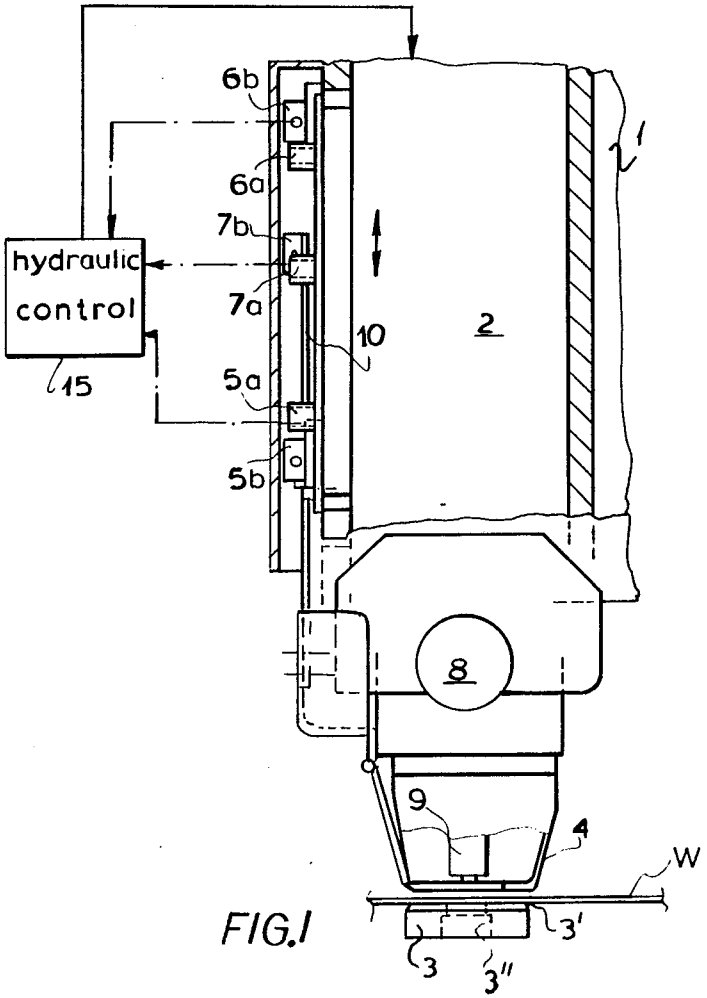
FIG. 1 is a side elevational view partly broken away of a portion of a punch according to my invention.

The punch partially shown in the drawing has a control mechanism for the displacement of a tool-carrying carriage. This punch basically comprises a machine frame 1, a punch tool carriage 2 movable up and down in the machine frame 1, a die-bearing member or anvil 3 having a hole 3'' for passing the punch tool 9, a workpiece receiving portion 3' for the workpiece w fixed relative to the machine frame 1 positioned opposite the punch tool carriage 2, a stripper 4 of adjustable height for different workpiece thicknesses mounted on the machine frame 1 and a hydraulic drive for the punch tool carriage 2 whose control is shown at 15.

The hydraulic drive control mechanism 15 has a plurality of controlling element pairs each comprising a control switch **5*b*, 6*b* and 7*b* and the associated control cam 5*a*, 6*a* and 7*a***.

One of the control cams **5*a*, 6*a* or 7*a* of a controlling element pair is mounted on the punch tool carriage 2 while the associated control switch 5*b*, 6*b* or 7*b*** is mounted on a machine part attached to the machine frame.

The lowest pair of the controlling element pairs, which as seen in the drawing comprises the cam and limit switch **5*a*, 5*b*, determines the lower limit point of travel for the punch tool carriage 2** and, of course, this lower limit point is adjustable in height for different operating conditions.

Furthermore, a controlling element pair **6*a*, 6*b* is provided, which determines or fixes the uppermost limit point of travel for the punch tool carriage 2** under certain conditions.

According to my invention, an additional special displacement-controlling element **7*b* is provided and connected to the stripper 4. The adjustment in height of stripper 4 is effected by the handwheel control 8 and indicated by the double arrow in the drawing. The associate controlling element (control cam 7*a*) is mounted on the punch tool carriage 2 at a height which is easily adjustable according to the length of different punch tools 9 and/or according to the height of the stripper 4**.

In the embodiment shown and according to an especially advantageous form of my invention, the displacement-controlling element **7*b* comprises a control switch. Consequently the associated controlling element 7*a* on the punch tool carriage 2 is a control cam. The stripper 4 has a controlling element supporting member 10 projecting vertically upward in the displacement direction of the punch tool carriage 2 from the stripper 4 and attached rigidly to it, and into the region where sufficient space for mounting the described component is available. The control element 7*a* associated with the displacement-controlling element 7*b* is guided on two vertical guide rods 11 on the punch tool carriage 2** and is fixed in position by clamping screws (not shown).

A measuring scale or ruler 12 is indicated in the drawing positioned next to the guide rods 11, which allows the position of the control element **7*a* associated with the displacement-controlling element 7*b* to be read. Accordingly, the controlling element pair 5*a*, 5*b* is provided for adjusting the lower limit point and the control element pair 6*a*, 6*b*** for the uppermost limit point.

In the example shown the control switches **5*a*, 6*a*, 7*a* are contact switches. One can also use or operate with a proximity detector, i.e. the control switches 5*a*, 6*a*, 7*a*** may be proximity detectors such as magnetic or reed switches.

I claim:

1. A punch press comprising:

a machine frame;

a carriage movable up and down on said machine frame;

a punch tool mounted on said carriage;

a die-bearing member having a workpiece-receiving portion mounted on said machine frame positioned opposite said punch tool;

a stripper mounted on said machine frame and adjustable vertically for different workpiece thicknesses; and a control mechanism for adjusting the stroke of said carriage on said machine frame, said mechanism comprising:

a plurality of controlling element pairs arranged in succession in the direction of displacement of said carriage, each controlling element pair including a control switch and an associated control cam, one element of each controlling element pair being mounted on said machine frame and the associated element of the respective controlling element pair being mounted on said carriage, and an additional controlling element pair arranged in said succession of controlling element pairs and including an additional control switch and an associated additional control cam, one additional element of said additional controlling element pair being mounted on said stripper and the associated additional element of said additional controlling element pair being positioned on said carriage according to the length of said punch tool and the position of said stripper.

2. The punch press defined in claim 1 wherein said one additional element mounted on said stripper is said additional control switch and said associated additional element mounted on said carriage is said additional control cam.

3. The punch press defined in claim 1 wherein said one additional element is mounted on said stripper by a support member guided vertically upward into the vicinity of said succession of controlling element pairs.

4. The punch press defined in claim 1, further comprising a pair of parallel guide rods mounted vertically on said carriage for guiding said one additional element of said additional controlling element pair.

5. The punch press defined in claim 2 wherein said additional control switch is a contact switch.

6. The punch press defined in claim 2 wherein said additional control switch is a proximity detector.

7. A punch press having a control mechanism for the displacement of a carriage having a punch tool mounted thereon comprising:

a machine frame;

a carriage movable up and down on said machine frame;

a punch tool mounted on said carriage;

twin guide rods mounted on said carriage and extending in the displacement direction thereof;

a die-bearing member having a workpiece-receiving portion and mounted on said machine frame positioned opposite said punch tool;

a stripper mounted on said machine frame and adjustable in height for different workpiece thicknesses; and a control mechanism having a plurality of controlling element pairs arranged in succession in the direction of displacement of said carriage, said controlling element pairs including a plurality of control cams and associated control switches, and a special one of said control switches connected by a support extending vertically upward from said stripper and mounted thereon, a special one of said control cams being associated with said special control switch, said special one of said control cams being slidably mounted on said twin guide rods and securable in position thereon according to the different lengths of said punch tool and the height of said stripper.

* * * * *